US010215348B2

(12) United States Patent
Gomi

(10) Patent No.: US 10,215,348 B2
(45) Date of Patent: Feb. 26, 2019

(54) LIGHTING DEVICE WITH OVERLAPPING OF ATTACHMENT FACES OF BASE MEMBER

(71) Applicant: NICHIA CORPORATION, Anan-shi, Tokushima (JP)

(72) Inventor: Masao Gomi, Shiojiri (JP)

(73) Assignee: NICHIA CORPORATION, Anan-shi (JP)

( * ) Notice: Subject to any disclaimer, the term of this patent is extended or adjusted under 35 U.S.C. 154(b) by 54 days.

(21) Appl. No.: 15/388,044

(22) Filed: Dec. 22, 2016

(65) Prior Publication Data

US 2017/0184264 A1 Jun. 29, 2017

(30) Foreign Application Priority Data

Dec. 25, 2015 (JP) ..... 2015-255396

(51) Int. Cl.

| | |
|---|---|
| ***F21S 43/15*** | (2018.01) |
| ***F21S 43/19*** | (2018.01) |
| ***F21S 8/04*** | (2006.01) |
| ***F21V 3/02*** | (2006.01) |
| ***F21V 23/00*** | (2015.01) |

(Continued)

(52) U.S. Cl.

CPC ..... *F21S 8/04* (2013.01); *F21S 43/15* (2018.01); *F21S 43/195* (2018.01); *F21V 3/02* (2013.01);

(Continued)

(58) Field of Classification Search

CPC ... B60Q 1/0041–1/0052; B60Q 1/2607; B60Q 1/2696; F21S 41/141; F21S 41/143; F21S 41/155; F21S 41/24; F21S 41/285; F21S 41/336; F21S 43/14; F21S 43/145; F21S 43/15; F21S 43/19; F21S 43/195;

(Continued)

(56) References Cited

U.S. PATENT DOCUMENTS 5,519,596 A * 5/1996 Woolverton ..... G09F 9/33 362/249.01
2005/0068781 A1* 3/2005 Nakayama ..... B60Q 1/2607 362/473

(Continued)

FOREIGN PATENT DOCUMENTS

JP 62-030386 A 2/1987
JP H04-81305 U 7/1992

(Continued)

*Primary Examiner* — Anh T Mai
*Assistant Examiner* — Steven Y Horikoshi
(74) *Attorney, Agent, or Firm* — Squire Patton Boggs (US) LLP

(57) ABSTRACT

A lighting device includes: a first board and a second board; a first light-emitting element mounted on the first board; a second light-emitting element mounted on the second board; and a base member including a first attachment face to which the first board is attached; and a second attachment face to which the second board is attached. As the lighting device is viewed from a light-emitting side, the first attachment face is disposed in front of the second attachment face. The second attachment face has an overlap area in which the second attachment face overlaps the first attachment face. The second light-emitting element is disposed in an area of the second attachment face different from the overlap area.

10 Claims, 9 Drawing Sheets

(51) Int. Cl.

| | |
|---|---|
| *F21Y 103/30* | (2016.01) |
| *F21Y 103/20* | (2016.01) |
| *F21Y 103/10* | (2016.01) |
| *F21Y 115/10* | (2016.01) |
| *F21Y 107/50* | (2016.01) |
| *F21Y 107/20* | (2016.01) |

(52) U.S. Cl.
CPC ..... *F21V 23/001* (2013.01); *F21Y 2103/10* (2016.08); *F21Y 2103/20* (2016.08); *F21Y 2103/30* (2016.08); *F21Y 2107/20* (2016.08); *F21Y 2107/50* (2016.08); *F21Y 2115/10* (2016.08)

(58) Field of Classification Search
CPC ..... F21S 43/235; F21S 43/236; F21S 43/239; F21S 43/241; F21S 43/243; F21S 43/249; F21S 43/26; F21S 48/115; F21S 48/1154; F21S 48/1163; F21S 48/1241; F21S 48/211; F21S 48/212; F21S 48/215; F21S 48/217; F21S 48/218; F21S 48/2281; F21V 29/503; H01L 33/642
See application file for complete search history.

(56) References Cited

U.S. PATENT DOCUMENTS

| | | | | |
|---|---|---|---|---|
| 2008/0285282 | A1 | 11/2008 | Karman et al. | |
| 2013/0329444 | A1* | 12/2013 | Oh ..... | F21V 21/00 362/543 |

FOREIGN PATENT DOCUMENTS

| | | | |
|---|---|---|---|
| JP | 2003-178610 | A | 6/2003 |
| JP | 2003-178611 | A | 6/2003 |
| JP | 2008-176996 | A | 7/2008 |
| JP | 2009-514157 | A | 4/2009 |
| JP | 2010-205553 | A | 9/2010 |
| JP | 2012-054199 | A | 3/2012 |
| JP | 2012-160430 | A | 8/2012 |
| JP | 2013-118201 | A | 6/2013 |
| JP | 2013-134857 | A | 7/2013 |
| JP | 2013-168434 | A | 8/2013 |
| JP | 3186175 | U | 9/2013 |
| JP | 2014-232646 | A | 12/2014 |
| JP | 2015-179567 | A | 10/2015 |

* cited by examiner

LIGHTING DEVICE WITH OVERLAPPING OF ATTACHMENT FACES OF BASE MEMBER

CROSS-REFERENCE TO RELATED APPLICATIONS

This application is based upon and claims the benefit of priority from Japanese Patent Application No. 2015-255396 filed on Dec. 25, 2015; the entire contents of which are incorporated herein by reference.

BACKGROUND OF THE INVENTION

1. Field of the Invention

This invention relates to a lighting device using a board on which multiple light-emitting elements are arrayed.

2. Description of the Related Art

Lighting devices using light-emitting diodes (LED) are used instead of fluorescent lamps in various shapes such as fluorescent tube lamps and fluorescent ring lamps (Japanese Patent Application Publication Nos. 2008-176996 referred to as Patent Document 1 and 2012-160430 referred to as Patent Document 2, for example). As an example, Patent Document 1 proposes a lighting device in which a flexible printed circuit board with light-emitting elements mounted thereon is fixed to a base member. This lighting device includes: a base member formed in a stair shape with an alternating series of first faces directed in a first direction and second faces directed in a second direction; and a flexible printed circuit board attached on the first faces and the second faces of the base member along the stair shape of the base member. Furthermore, in the lighting device, light-emitting elements are mounted on the portions of the flexible printed circuit board on the first faces of the base member, while components other than the light-emitting elements are mounted on the portions of the flexible printed circuit board on the second faces of the base member.

As another example, Patent Document 2 proposes a lighting device. In this lighting device, a flexible printed circuit board (FPC) in which a copper-foil pattern (conductor) integrated with a film is further integrated with a flexible metal-made base to form a metal base FPC, and light-emitting elements and a lighting control circuit are provided to the metal base FPC. In the lighting device, the metal base FPC is bent while being kept away from a lamp body, and at least one attachment mechanism is provided to attach an end portion of the metal base FPC to the lamp body. Here, in the lighting device, the metal base FPC is integrated with the metal-made base along the shape of the stair-shaped metal-made base.

In the related lighting devices discussed above, the flexible printed circuit board is fixed to the base member or the metal-made base by being folded at an angle along the stair shape of the base member or the metal-made base. Such attachment work of the flexible printed circuit board requires time and efforts, and may cause a break in wirings in the flexible printed circuit board.

Furthermore, the light-emitting elements placed on the center side of the flexible printed circuit board are fixed at the center sides of the first faces of the base member or the metal-made base in the stair shape with treads and risers at right angle. With this construction, since the whole portions of the flexible printed circuit board on the first faces are exposed in the light-emission direction, the lighting devices as a whole is large in size.

SUMMARY OF THE INVENTION

The invention is directed to a lighting device in which a board is easy to attach and wirings are less likely to break. The invention is directed to a lighting device which is made smaller while maintaining the light intensity.

According to an aspect of the invention, a lighting device includes: a first board and a second board; a first light-emitting element mounted on the first board; a second light-emitting element mounted on the second board; and a base member including a first attachment face to which the first board is attached; and a second attachment face to which the second board is attached. As the lighting device is viewed from a light-emitting side, the first attachment face is disposed in front of the second attachment face. The second attachment face has an overlap area in which the second attachment face overlaps the first attachment face. The second light-emitting element is disposed in an area of the second attachment face different from the overlap area.

The lighting device brings about the following excellent advantageous effects.

In the lighting device, the long first and second boards are fixed along the first and second attachment faces without being folded, and thus the first and second boards are easy to fix. In addition, in the lighting device, the base member is made substantially smaller than ever because the first attachment face overlaps a portion (overlap area) of the second attachment face with a space in between, which makes it possible to reduce the size of the lighting device as a whole.

DETAILED DESCRIPTION OF THE EMBODIMENTS

Figure 1:
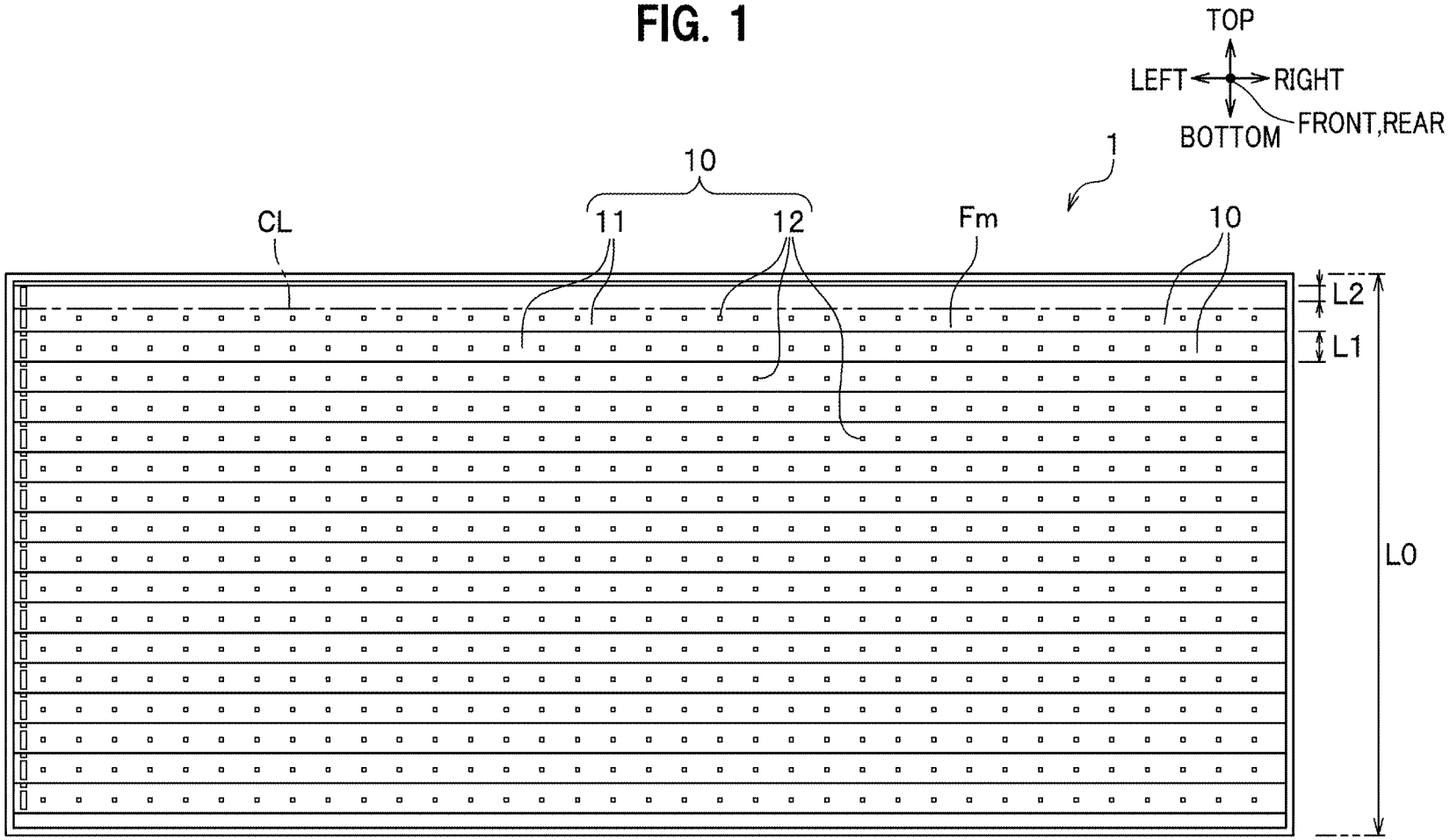
FIG. 1 is a front view schematically illustrating an overall construction of a lighting device of a first embodiment.

Lighting devices of the respective embodiments will be hereinafter described with reference to the drawings. It should be noted that the drawings referred to in the following descriptions schematically illustrate the embodiments; and in some cases, therefore, scales of components, spaces between components, positional relationships among components, and the like are exaggerated, as well as illustrations of parts of components are omitted. In the following descriptions, the same names and reference signs denote the same or equivalent members in principle. Detailed descriptions for such members will be omitted when deemed appropriate. Moreover, directions indicated in the drawings illustrate relative positions among components, and are not intended to illustrate absolute positions of components.

First Embodiment

Referring to FIGS. 1 to 4, descriptions will be provided for a construction of a lighting device of a first embodiment.

Figure 2:
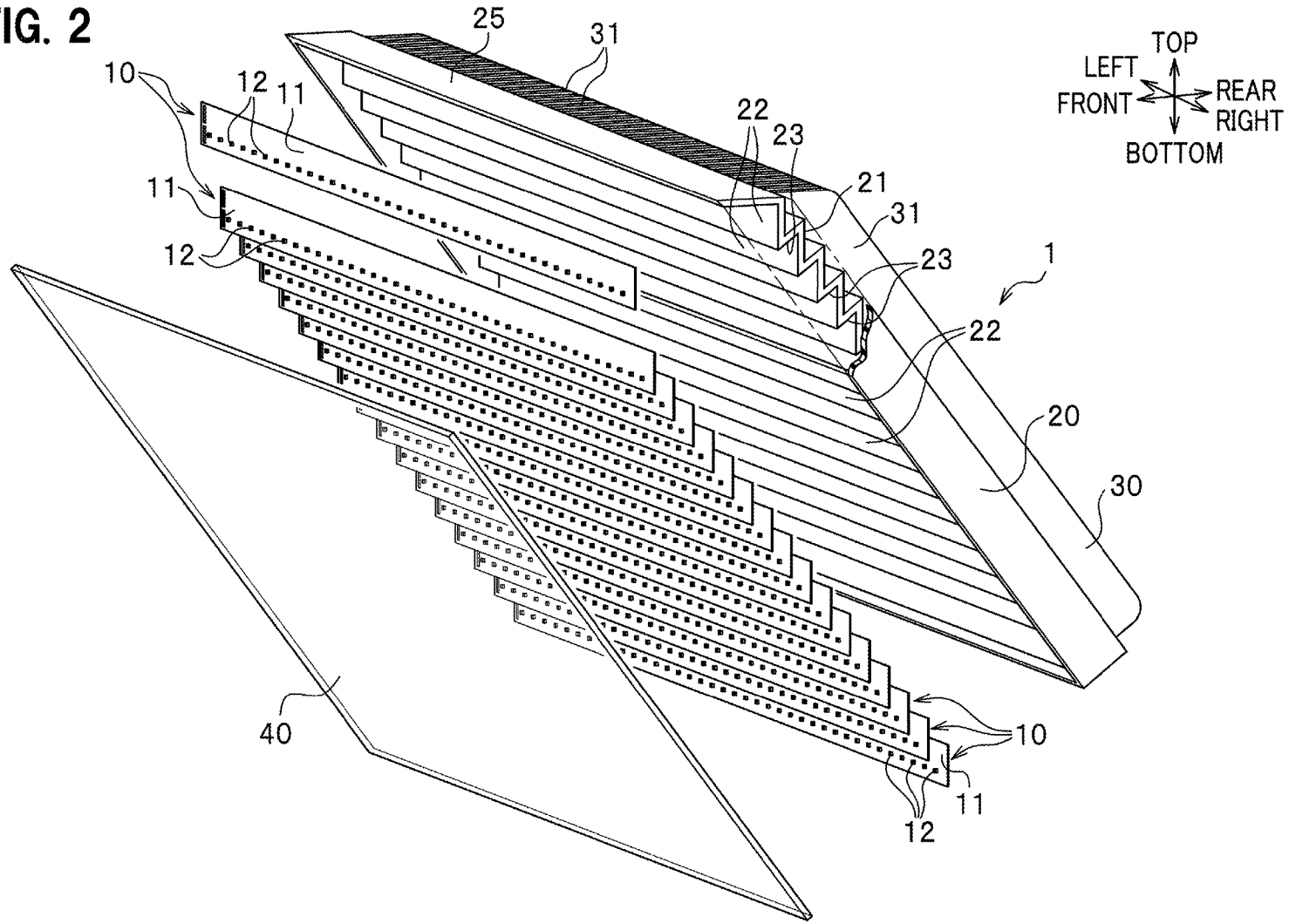
FIG. 2 is an exploded perspective view schematically illustrating the lighting device of the first embodiment exploded and partially cut out.

As illustrated in FIGS. 1 and 2, the lighting device 1 mainly includes multiple long light emitters 10, and a base member 20 for supporting the light emitters 10. Incidentally, in the lighting device 1, the base member 20 includes: a heat radiation mechanism 30 for radiating heat from the light emitters 10; and a protection cover 40 covering a light-emitting surface side of the light emitters 10. In addition, the base member 20 of the lighting device 1 will be described with a stair-shaped construction in which first and second attachment faces as attachment faces 22 are alternately formed with connecting faces 23 in between. Instead, the construction of the base member 20 may be such that one first attachment face 22 and one second attachment face 22 are only connected to one connecting face 23.

Each light emitter 10 includes: a flexible board 11 of a long board; and multiple light-emitting elements 12 mounted on the flexible board 11 at predetermined intervals in a longitudinal direction of the flexible board 11. Although the light emitter 10 may use an inflexible board, descriptions will be provided for the light emitter 10 using the flexible board 11 with flexibility. The flexible board 11 described below may be used for first boards on which multiple light-emitting elements 12 are mounted, and for second boards on which multiple light-emitting elements 12 are mounted. In this case, a first board is referred to as a "first flexible board," and a second board is referred to as a "second flexible board." Furthermore, in structures in drawings including the first attachment faces are arranged in front of the second attachment faces, a first board is attached to each first attachment face, and a second board is attached to each second attachment face.

Figure 4:
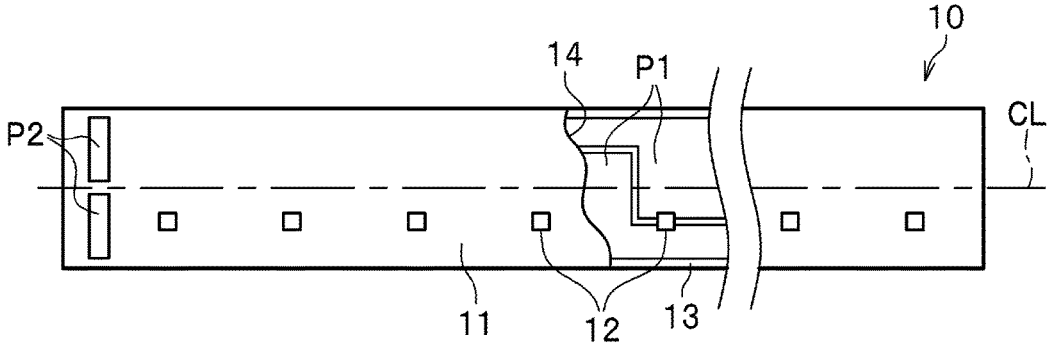
FIG. 4 is a plan view schematically illustrating a positional relationship between a flexible board and light-emitting elements in the lighting device of the first embodiment with part of the flexible board omitted.

As illustrated in FIG. 4, the flexible board 11 includes: a flexible and pliable base material 13; and wiring patterns P1 and wirings P2 formed in the base material 13.

The base material 13 is made of a resin film or the like, and has excellent flexibility and pliability. The base material 13 is long in shape. In the embodiment, the base material 13 is shaped as a belt. A film-shaped insulating material made, for example, from a polyimide, a liquid crystal polymer (LCP), polyethylene terephthalate (PET) or the like is used as a material of the base material 13. In addition, it is desirable that the base material 13 is heat-resistant as well. For this reason, examples of the material preferably usable for the base material 13 includes: an organic insulating material of an epoxy resin, a phenolic resin or the like, and a material obtained by impregnating paper or cloth with such an organic insulating material; and a flexible organic insulating material of a polyester, a polyetherimide or the like.

A melamine resin, an acrylonitrile styrene (AS), a polymethyl methacrylate (PMMA) or the like is usable for the base material 13. Otherwise, a thermosetting polymer resin, a photocuring polymer resin, an electron-beam curing polymer resin may be used for the base material 13. Meanwhile, if made of a fluorine-based polymer film such as a fluorinated ethylene propylene (FEP) film (a tetrafluoroethylene-hexafluoropropylene copolymer resin film), the base material 13 also has an advantage of being thermocompression-bonded easily to a metal board or the like. In addition, it is desirable to use a translucent film from the viewpoint of light extraction. Furthermore, a heat-resistant fiber material, a fire-retardant thin film fiber material or the like may be used for the base material 13. The base material 13 is not particularly limited in the shape, size or thickness, but may be formed in any shape and size with any thickness depending on the number and sizes of members including the light-emitting elements 12 placed (mounted) on the flexible board 11. Moreover, a light-reflecting member 14 made of a white resin, for example, may be provided onto the surface of the base material 13.

As illustrated in FIG. 4, the wiring patterns P1 formed on one surface of the flexible board 11 are made of a metal material such as metal foil, and supply electric power to the light-emitting elements 12. For each light-emitting element 12, the wiring patterns P1 are formed as a pair of an anode and a cathode. Incidentally, the wiring patterns P1 are set in advance in order to supply electric power to other surface mounted components (not illustrated), such as Zener diodes, than the mounted light-emitting element 12. In addition, the flexible board 11 includes the wirings P2 arranged at a one-end side of the wiring patterns P1 in the longitudinal direction, and electrically connected to an external power supply or other light emitters 10. The wirings P2 are made of the same metal material as are the wiring patterns P1.

As illustrated in FIG. 2, the light-emitting elements 12 are mounted on the wiring patterns P1 provided in a mounting area of the flexible board 11, and arrayed at predetermined intervals in the longitudinal direction of the flexible board 11. Furthermore, as illustrated in FIG. 4, the light-emitting elements 12 are arrayed in the area from a width-direction center line CL of the flexible board 11 to one side-end portion of the flexible board 11. The light-emitting elements 12 are semiconductor elements such as LED chips, and their semiconductor layers form light-emitting portions. The semiconductor layers are formed on the C plane (principal plane) of a sapphire substrate with a buffer layer interposed in between, for example. The semiconductor layers each includes a structure in which an n-type semiconductor layer, an active layer and a P-type semiconductor layer are stacked together in this order from the bottom. Furthermore, the active layer has a quantum well structure including a well layer (light-emitting layer) and a barrier layer, for example.

The semiconductor layers may be made of GaN, AlN, InN, or a III-V group nitride semiconductor ($In_XAl_YGa_{1-X-Y}N$, where $0 \leq X$, $0 \leq Y$, and $X+Y \leq 1$) which is their mixed crystal.

The light-emitting elements 12 each have a structure which is suitable for the flip chip mounting such that the structure includes: the semiconductor layer having a light-emitting diode structure and arranged on the one principal plane of the substrate; and an n-side electrode and a p-side electrode arranged on one surface of the semiconductor layer. The light-emitting elements 12 are mounted on the flexible board 11, for example, by being connected to the wiring patterns P1 in the mounting area of the flexible board 11 via bumps or anisotropic conductive members. Incidentally, the light-emitting elements 12 may be covered with a wavelength conversion member (not illustrated). The wavelength conversion member converts light from the light-emitting elements 12 into light with a wavelength which is different from that of the light from the light-emitting elements. An example of the wavelength conversion member is a group of particles of a fluorescent substance. The wavelength conversion member covers the light-emitting elements 12 with a binder such as a resin interposed in between. White illumination light is obtained, for example, from blue LEDs as the light-emitting elements 12 by using a yellow light-emitting fluorescent substance as the wavelength conversion member.

The light emitters 10 are arrayed by being attached to the base member 20 to emit light in a predetermined direction.

Figure 3:
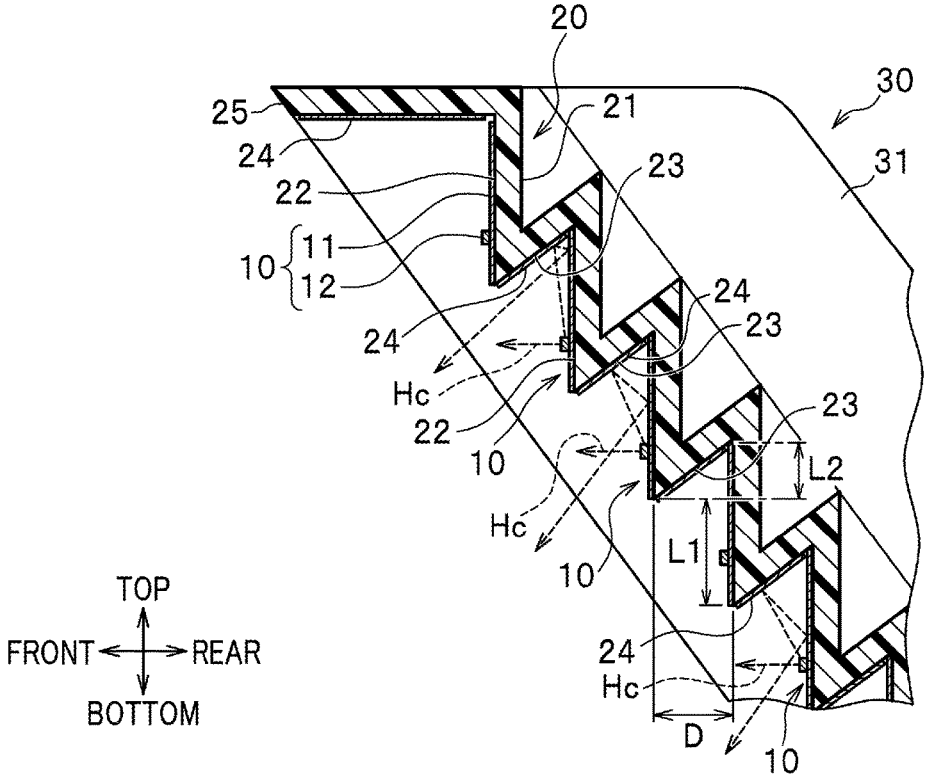
FIG. 3 is an enlarged cross-sectional view schematically illustrating a base member in the lighting device of the first embodiment with part of the base member omitted from the enlarged cross-sectional view.

As illustrated in FIGS. 2 and 3, the base member 20 includes: a support body 21 formed in the shape of steps; and the heat radiation mechanism 30 provided on the back surface side of the support body 21. In this respect, the base member 20 includes the support body 21 and the heat radiation mechanism 30 which are integrally formed.

The support body 21 includes: the multiple attachment faces (first and second attachment faces) 22 provided on a front-surface side of the support body 21; the connecting faces 23 connected to the attachment faces 22 with a predetermined level difference in between; and an edge portion 25 provided on the circumferential edge of the attachment faces 22. In this respect, the connecting faces 23 are provided over between the attachment faces 22 and 22, respectively. Furthermore, angles between the attachment faces 22 and the connecting faces 23 are acute angles.

Each attachment face 22 has a flat surface extending in the left-right direction such that the flexible board 11 can be attached to the attachment face 22 without being folded at an angle and the light emitter 10 can be mounted on the flexible board 11 held flat. The flat surface of the attachment face 22 has a width and a length equal to or longer than the flexible board 11 of the light emitter 10. In addition, the attachment faces 22 are arranged such that an attachment face 22 connected to one end of each connecting face 23 exists above and away from one end of an attachment face 22 connected to the other end of the connecting face 23. Specifically, in a plan view of the lighting device 1 from the light-emitting side, the attachment face 22 of the first attachment face is arranged in front of the attachment face 22 of the second attachment face and overlaps a portion of the attachment face 22 as the second attachment face. In other words, their positional relationship is such that one end of the attachment face 22 connected to one end of the connecting face 23 is away from and opposite to the attachment face 22 connected to the other end of the connecting face 23. In this embodiment, in the front view where the attachment faces 22 are viewed from the front, each two neighboring attachment faces 22 are arranged away from each other with a connecting face 23 interposed in between such that the above-placed attachment face 22 covers 10 to 40% of the area of the below-placed attachment face 22.

One connecting face 23 is provided throughout between each two neighboring attachment faces 22, 22. The connecting face 23 is arranged to separate the attachment faces 22, 22 away from each other, and to thereby form a step between the thus-separated attachment faces 22, 22. Furthermore, the connecting face 23 is placed between the attachment faces 22, 22 such that the base member 20 forms acute angles between the connecting face 23 and the attachment faces 22, 22 connected to one and the other ends of the connecting face 23. An area L2 or overlap area of a portion of the below-placed attachment face 22 to be covered by a portion of the above-placed attachment face 22 with the space in between is set by adjusting the angles of the connecting face 23 to the respective attachment faces 22, and the length of the connecting face 23. The connecting face 23 is connected to the above-placed attachment face 22 at the acute angle, and inclines to face upward relative to the horizontal plane. Furthermore, in the base member 20, the connecting faces 23 are at the acute angles to the attachment faces 22. Thus, in the base member 20, the depth D from the higher attachment face 22 to the lower attachment face 22 in the front-rear direction is made shorter than conventional base members with the connecting faces at right angles. Here, provided that a length of the attachment faces 22 in the top-bottom direction is 1, a length of the connecting faces 23 is set equal to or less than 1. In this case, the depth D is made much smaller, and the amount of light emitted toward the front increases. In other words, with the short length of each connecting face 23 between the attachments faces 22, the below-located attachment face 22 next to the above-located attachment face 22 comes closer to the front side, and accordingly the amount of light emitted directly toward the front from the light-emitting elements 12 increases. For this reason, the length of the connecting faces 23 may be set at a ratio to the attachment faces 22 of less than 0.7. In addition, the front-surface side of each connecting face 23 may be provided with the light-reflecting member 24 made of a white resin or the like. The space-side angle of the front surface of the connecting face 23 to the front surface of the attachment face 22 located in front of the connecting face 23 is greater than 270 degrees but less than 360 degrees.

The circumferential edge of the attachment faces 22 is provided with the edge portion 25 which is formed therein to extend forward from the attachment faces 22. The edge portion 25 is that to which the protection cover 40 is attached to protect the light-emitting elements 12 and the flexible boards 11 from dust. The edge portion 25 is formed such that when the protection cover 40 is attached to the edge portion 25, the distance from the light-emitting elements 12 to the protection cover 40 is kept constant. The edge portion 25 may be formed with a height which allows the end surface of the edge portion 25 in contact with the protection cover 40 to be on the same plane for the purpose of joining the protection cover 40 to the edge portion 25 with joining means such as an adhesive.

When the flexible boards 11 of the light emitters 10 are attached to the respective attachment faces 22 with an adhesive or the like, the support body 21 having the above-described construction makes the attachment faces 22 nearer to the light-emitting side of the lighting device 1 overlap the portions of the attachment faces 22 farther from the light-emitting side of the lighting device 1, as illustrated in FIGS. 1 and 3. In other words, upper areas L2 of the flexible boards 11 are covered by portions of the above-placed attachment faces 22, and the other areas L1 of the flexible boards 11 are exposed toward the front. In addition, in the front view, the optical axes Hc of the light-emitting elements 12 are exposed without overlapping the above-placed attachment faces 22.

This makes it possible to make the number of light-emitting elements 12 per unit area in a whole length L0 of a light-emitting surface Fm become larger in the lighting device 1 than in the conventional lighting devices. Furthermore, since in each light emitter 10, the light-emitting elements 12 are arranged lower than the width-direction center line CL of the flexible board 11 (see FIG. 3), the amount of light to be emitted from the light-emitting elements 12 to the connecting face 23 is reduced, and the amount of light to be emitted from the light-emitting elements 12 directly toward the front is increased. Moreover, since the support body 21 allows the light emitters 10 to be flatly attached to the attachment faces 22, the flexible boards 11 need not be bent at an angle at a location from the light-emitting elements 12 to the connecting face 23, and the attachment work accordingly becomes easy to perform.

As illustrated in FIGS. 2 and 3, the heat radiation mechanism 30 is provided on the back surface of the support body 21, and radiates heat produced by the light emission of the light-emitting elements 12 to the atmosphere. The heat radiation mechanism 30 includes multiple fins 31 each shaped as a thin plate, and each continuing on the stair-shaped back surface of the support body 21, each projecting backward of the support body 21, and arranged at predetermined intervals in the left-right direction. The heat radiation mechanism 30 makes the area of the contact between the fins 31 and the support body 21 larger than the conventional structure including the connecting faces which are at right angles to the attachment faces, and enhances heat radiation performance.

As illustrated in FIG. 2, the protection cover 40 protects the light emitters 10 from dust, rain water and the like when the light emitters 10 are used indoor and outdoor. The protection cover 40 is formed of a translucent member made of glass, resin or the like which transmits light. Instead, the protection cover 40 may be made of frosted glass or resin which diffuses the light from the light-emitting elements 12. Incidentally, although the drawing illustrates the protection cover 40 with the same thickness, the front or back surface of the protection cover 40 may include convex and concave portions which are formed to be arrayed in the column, row or matrix direction. Moreover, in the case where the protection cover 40 is provided with the convex and concave portions, the convex portions or the concave portions each play roles of lenses.

In a view from the front, the area of the lighting device 1 having the above-described construction can be reduced to approximately 10 to 60% of those of the conventional devices in which the connecting faces are formed at right angles to the attachment faces, even though the number of light-emitting elements 12 arrayed in the lighting device 1 is equal to the number of light-emitting elements arrayed in the conventional lighting devices. When the acute angles of the connecting faces 23 to the attachment faces 22 are adjusted according to purposes, the size of the light-emitting surface Fm can be made to serve the purposes. This increases the design freedom. Furthermore, the dimension (depth D) of the lighting device 1 in the front-rear direction is smaller than those of the conventional devices in which the connecting faces are formed at right angles to the attachment faces. In addition, the acute angles of the connecting faces 23 to the attachment faces 22 allows light reflected off the connecting face 23, or the connecting face 23 and the attachment faces 22, to be sent downward of the lighting device 1 as well.

Figure 5:
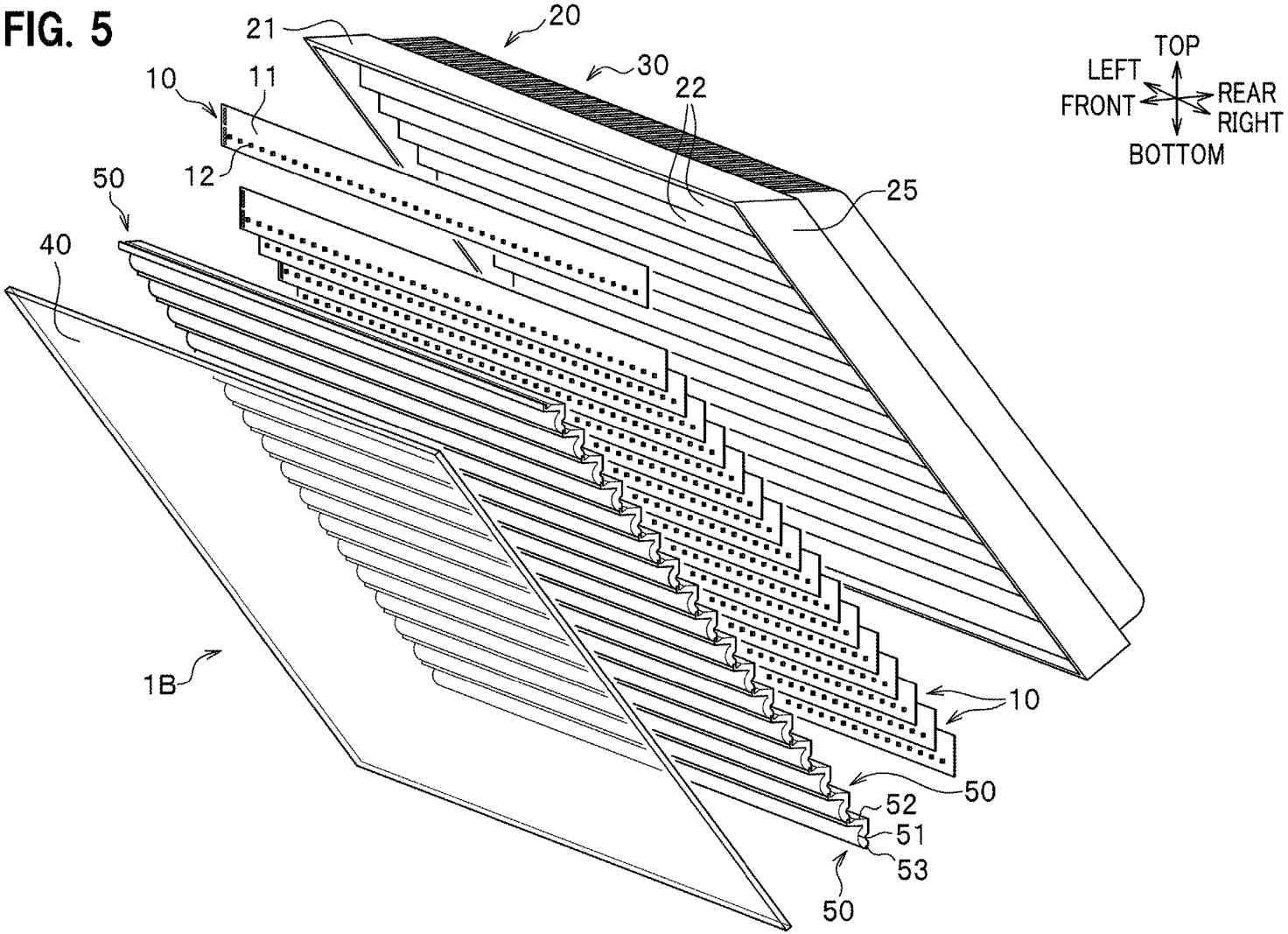
FIG. 5 is an exploded perspective view schematically illustrating a lighting device of a second embodiment.
Figure 6:
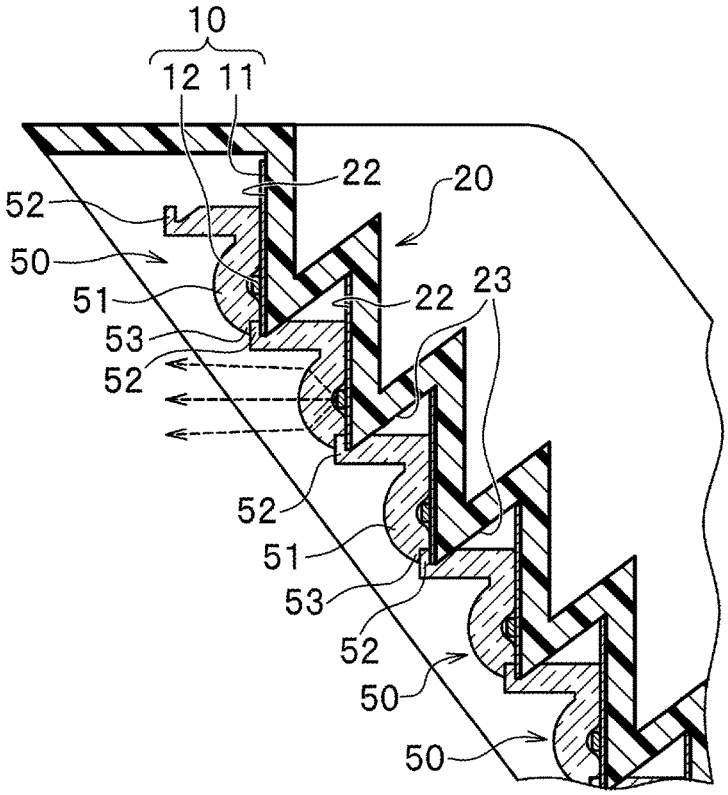
FIG. 6 is an enlarged cross-sectional view schematically illustrating a base member in the lighting device of the second embodiment with part of the base member omitted from the enlarged cross-sectional view.

Next, referring to FIGS. 5 and 6, descriptions will be provided for a lighting device 1B of a second embodiment. Incidentally, components which are the same as those already described will be denoted by the same reference signs, and descriptions for such components will be omitted whenever deemed appropriate.

As illustrated in FIG. 5, in the lighting device 1B, lenses 50 are provided to the respective light emitters 10. The lighting device 1B mainly includes: the multiple long light emitters 10; the base member 20 for supporting the light emitters 10; and the lenses 50 set on the light emitters 10. Incidentally, in the lighting device 1B, the base member 20 includes the heat radiation mechanism 30 for radiating heat from the light emitters 10; and the protection cover 40 covering a light-emitting surface side of the light emitters 10, like in the lighting device 1.

The light-emitting elements 12 on each light emitter 10 are covered with the lens 50. The lens 50 guides light from the light-emitting elements 12 in a specific direction. For example, the lenses 50 are set on the respective light emitters 10, and formed in a longitudinal direction of the flexible board 11. In this case, lenses working as convex lenses (cylindrical lenses) are used for the lenses 50. The lenses 50 refract light emitted from the light-emitting elements 12 to convert the light into parallel beams, and outputs the resultant parallel beams. Each lens 50 includes: a light refraction portion 51 covering the light-emitting elements 12; a first engagement portion 52 formed in one peripheral edge (an upper end) of the light refraction portion 51, and continuing along the one peripheral edge; and a second engagement portion 53 formed in the other peripheral edge (a lower end) of the light refraction portion 51, and continuing along the other peripheral edge.

In order for the light refraction portion 51 to continuously extend and cover the light-emitting elements 12 on the flexible board 11, the light refraction portion 51 has a constant cross section continuing in the longitudinal direction of the flexible board 11. The light refraction portion 51 has a concave surface on the light-incident side, and is set out of contact with the light-emitting elements 12 while the light-emitting elements 12 are set in a space surrounded by the concave surface. A light-emission side of the light refraction portion 51 forms a convex surface, and the convex surface is formed with a curvature for a convex lens in order that the light refraction portion 51 converts the light incident onto the light refraction portion 51 from the light-emitting elements 12 into a parallel beam, and outputs the resultant parallel beam. In addition, peripheral portions of the concave surface of the light refraction portion 51, which faces the flexible board 11, are formed flat, and are in contact with the flexible board 11. Moreover, the first engagement portion 52 capable of engaging with another lens 50 and another flexible board 11 is formed in the one peripheral edge, or the upper peripheral edge, of the light refraction portion 51, while the second engagement portion 53 capable of engaging with yet another lens 50 is formed in the other peripheral edge, or the lower peripheral edge, of the light refraction portion 51. The first and second engagement portions 52, 53 and the light refraction portion 51 are integrated into a unit.

The first engagement portion 52 is formed in the upper (one) end portion of the light refraction portion 51, and continuously extends in the longitudinal direction (the left-right direction) of the attachment face 22. The first engagement portion 52 is shaped as a wall surface, and projects (forward) in a direction orthogonal to the attachment face 22 of the base member 20. A triangular cross section groove portion is formed in an upper side surface of the wall surface. The groove portion of the first engagement portion 52 is formed to continuously extend in the longitudinal direction of the attachment face 22. The first engagement portion 52 comes into engagement with the base material 20 when: the first engagement portion 52 enters and is fitted into the groove portion of the second engagement portion 53 of the above-placed lens 50; and a lower-end corner portion of the step of the base material 20 is fitted into the triangular cross section groove portion.

The second engagement portion 53 is formed in the lower (other) end portion of the light refraction portion 51, and continuously extends in the longitudinal direction (the left-right direction) of the attachment face 22. The second engagement portion 53 has a rectangular cross section groove portion, which is open toward the side end of the lens 50 and the attachment face 22 of the base member 20 and, formed to continuously extend in the longitudinal direction. The second engagement portion 53 comes into engagement with the first engagement portion 52 when the tip end portion of the first engagement portion 52 of the below-placed lens 50 is fitted into the groove portion.

After the light emitters 10 are set respectively on the multiple attachment faces 22 of the base material 20, the lenses 50 having the above-described structure are set respectively on the light emitters 10 in order starting with the lens 50 for the light emitter 10 located at the top or the bottom. For example, in order to set the lenses 50 respectively on the light emitters 10 in bottom-to-top order starting with the lens 50 for the light emitter 10 located at the bottom, the lowermost lens 50 is set on the light emitter 10 by: placing the lens 50 on the light emitter 10 with the convex surface of the light refraction portion 51 facing the light-emitting elements 12; and fitting the lower-end portion of the above-placed attachment face 22 into the groove portion of the first engagement portion 52. Thereafter, the next lens 50 is set on the next light emitter 10 by: fitting the tip end portion of the first engagement portion 52 of the previously-placed lens 50 into the groove portion of the second engagement portion 53; making the convex surface of the light refraction portion 51 face the light-emitting elements 12 of the light emitter 10; and fitting the lower-end portion of the above-placed attachment face 22 into the groove portion of the first engagement portion 52. After that, all the other lenses 50 are set on the light emitters 10 provided on all the other attachment faces 22 by performing the same operation on the light emitters 10. Incidentally, each lens 50 may be attached to the base member 20, for example by applying an adhesive to the peripheral edge of the light refraction portion 51 which faces the flexible board 11 or the inside of the groove portion of the first engagement portion 52.

It should be noted that the height of the edge portion 25 of the base member 20 is set such that when the lenses 50 are set on the light-emitting elements 12, the protection cover 40 attached to the edge portion 25 is far enough away from, and accordingly does not come into contact with, the lenses 50.

Once the light-emitting elements 12 are lit, the lighting device 1B having the above-described construction outputs the emitted light through the lenses 50, allows the light to pass through the protection cover 40, and eventually emits the light to the outside. In addition, since the lenses 50 are set therein, the lighting device 1B is capable of controlling the light-emission direction, and increasing design freedom of the orientation characteristic.

Figure 7:
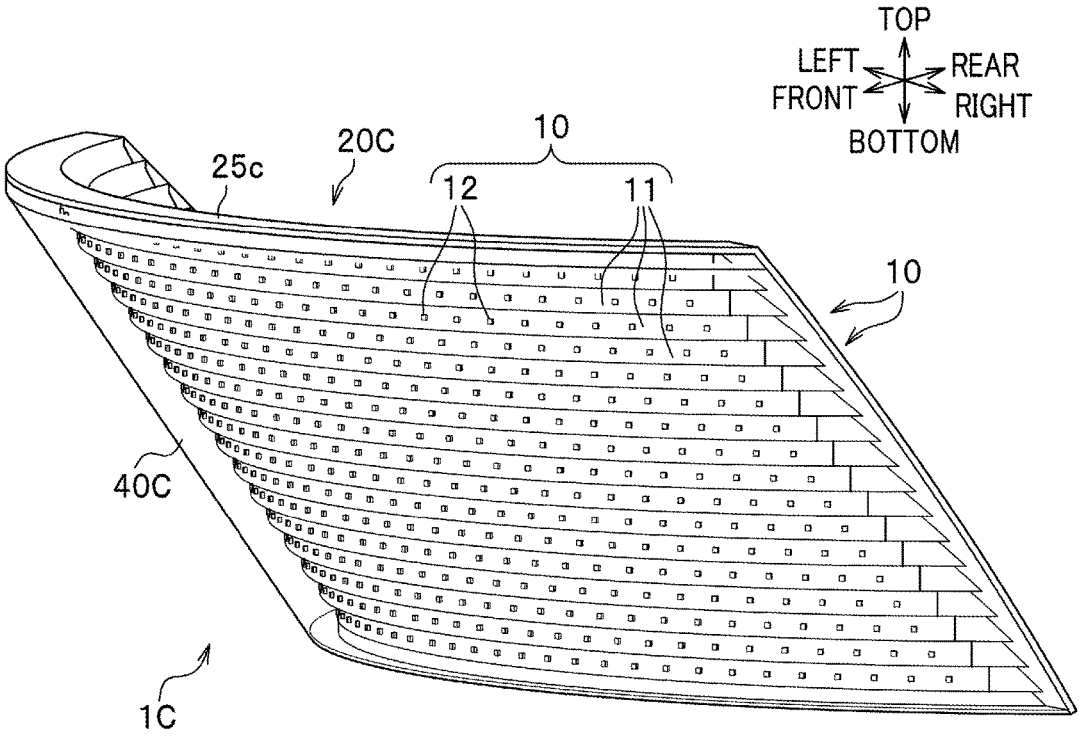
FIG. 7 is a perspective view schematically illustrating a lighting device of a third embodiment.
Figure 8:
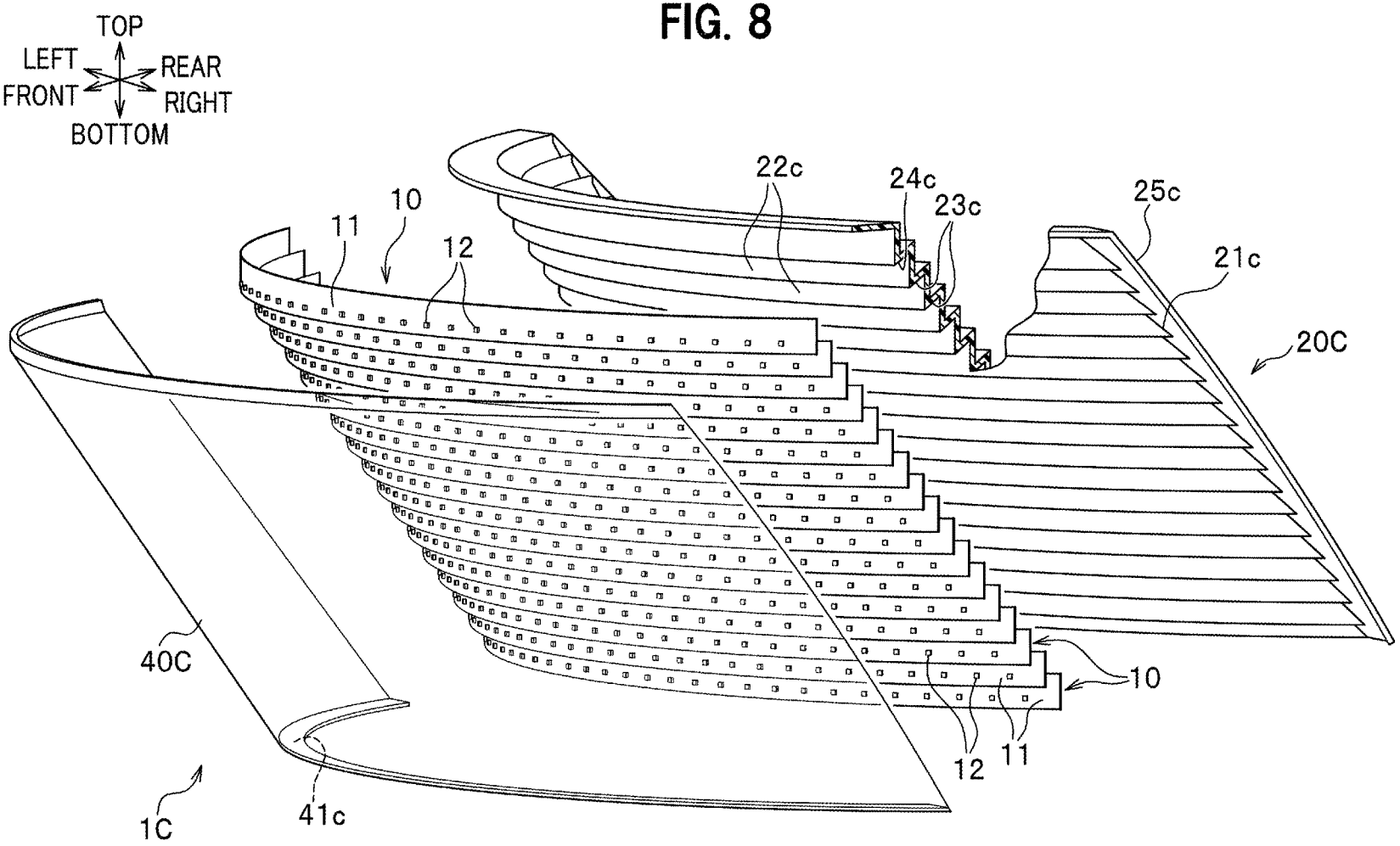
FIG. 8 is an exploded perspective view schematically illustrating the lighting device of the third embodiment in combination with a cross section of part of the lighting device.

Next, referring to FIGS. 7 and 8, descriptions will be provided for a lighting device 1C of a third embodiment. Incidentally, components which are the same as those already described will be denoted by the same reference signs, and descriptions for such components will be omitted whenever deemed appropriate.

The lighting device 1C is different from the lighting device 1 described using FIG. 1 in that: a base member 20C curves forward in a convex form; and the other components curve according to the shape of the base member 20C. The lighting device 1C will be hereinbelow described focusing on what make the lighting device 1C different from the lighting device 1.

As illustrated in FIGS. 7 and 8, the lighting device 1C mainly includes: the long light emitters 10; and the base member 20C for supporting the light emitters 10 while keeping the light-emitting devices 10 curved. A protection cover 40C for covering the light emission surface-side of the light emitters 10 is attached.

The base member 20C is formed as supporting bodies 21*c* partially or wholly bent to be shaped like a curve. Incidentally, in this embodiment, the base member 20C, whose construction includes no heat radiation mechanism, will be described. In addition, the base member 20C, which has a stair-shaped construction including first attachment faces 22*c* and second attachment faces 22*c* alternately formed with connecting faces 23*c* in between, will be described. Otherwise, the construction of the base member 20C may be such that the first attachment faces 22*c* and the second attachment faces 22*c* are only connected to the connecting faces 23*c*.

The supporting body 21*c* includes the attachment faces 22; the connecting faces 23*c* connected to the attachment faces 22*c* while forming an acute angle to the attachment faces 22*c*; and an edge portion 25*c* provided to some of the peripheral edges of the whole group of the attachment faces 22*c*. The multiple supporting bodies 21*c* are provided such that the support faces 22*c* and the connecting faces 23*c* constitute a series of steps. Each supporting body 21*c* is shaped as a curved surface such that: the supporting body 21*c* gently curves from one end toward the other end in the left-right direction; and beyond the center of the supporting body 21*c* in the left-right direction (in the drawing, beyond three quarters of the supporting body 21*c*), the supporting body 21*c* largely curves in a convex form. The curving shape of the supporting body 21*c* is such that: the supporting body 21*c* curves forward in a convex form with respect to the left-right direction; and the curvature of the supporting body 21*c* is larger in one end portion of the supporting body 21*c*, and is smaller in the center portion and the other end portion of the supporting body 21*c* in the left-right direction. Furthermore, in this case, the curving shape of the supporting body 21*c* is formed such that the supporting body 21*c* does not curve in the up-down direction.

Each attachment face 22*c* is shaped like a curved surface such that: the attachment face 22*c* gently curves from one end toward the other end; and beyond the center of the attachment face 22*c* in the left-right direction (in the drawing, beyond three quarters of the attachment face 22*c*), the attachment face 22*c* largely curves. The attachment faces 22*c* are formed according to the curving shape of the support body 21. In addition, the attachment faces 22*c* are as wide and long as, or wider and longer than the flexible boards 11 of the light emitters 10. Each attachment face 22*c* is connected at one end and the other end in the up-down direction, respectively, to the neighboring connecting faces 23*c*. Furthermore, an attachment face 22*c* connected to one end of a connecting face 23*c* exist above and away from (opposite to), one end of another attachment face 22*c* connected to the other end of the connecting face 23*c*. In other words, each two neighboring attachment faces 22*c* are set away from each other with a connecting face 23*c* interposed in between such that a portion of an above-placed one of the attachment faces 22*c* covers a portion of a below-placed one of the attachment faces 22*c*. In this embodiment, each two neighboring attachment faces 22*c* are set away from each other with a connecting face 23*c* interposed in between such that the above-placed one of the attachment faces 22*c* covers 10 to 40% of the area of the below-placed one of the attachment faces 22*c*.

Each connecting face 23*c* is formed curving along, and is provided across, the neighboring attachment faces 22*c*. An angle of the connecting face 23*c* to each of the attachment faces 22*c* is an acute angle. An angle of the connecting face 23*c* to the above-placed attachment faces 22*c* is set at an angle less than 90 degrees, or an acute angle. Thereby, the connecting face 23*c* inclines upward relative to the horizontal plane. The connecting face 23*c* is formed curving along the neighboring attachment faces 22*c* such that the clearances between the connecting face 23*c* and the attachment faces 22*c*, as well as the curving shape of the connecting face 23*c* are constant in the up-down direction.

The edge portion 25*c* is formed along three of the four sides which are the peripheral edges of the whole group of the multiple attachment faces 22*c*, but not along the bottom side of the four sides. The edge portion 25*c* is formed in a first place where there is one side constituting the uppermost peripheral edge of the whole group of the multiple attachment faces 22*c* in the short-length direction, and in second and third places where there are two sides constituting peripheral edges at two ends of the whole group of the multiple attachment faces 22*c* in the longitudinal direction. The edge portion 25*c* in the first place is formed to be located extending along the curved surfaces of the attachment faces 22*c*, projecting forward from the attachment faces 22*c* with respect to the longitudinal direction, and inclining such that angles of the edge portion 25*c* to the attachment faces 22*c* are obtuse angles. Meanwhile, the edge portion 25*c* in the second and third places is located extending along the sides at one end and the other ends of the whole group of the multiple attachment faces 22*c* in the longitudinal direction, inclining in a direction extending outward from the attachment faces 22*c*, and projecting forward from the attachment faces 22*c*. The edge portion 25*c* and a cover edge portion 41*c* formed in the protection cover 40C in combination cover the peripheral edges of the whole group of the multiple attachment faces 22*c*, and protect the light-emitting elements 12 and the flexible boards 11. On the remaining peripheral edge of the support body 21*c* along which no edge portion 25*c* is formed, the lower end of the lowermost attachment face 22*c* serves as an end portion of the support body 21*c*.

The protection cover 40C is formed curving according to the shape of the support body 21*c*. The cover edge portion 41*c* is formed along the one of the four peripheral sides of the protection cover 40C. The cover edge portion 41*c* and the edge portion 25*c* of the support body 21*c* in combination surround the four peripheral side surfaces of the support body 21*c*. The cover edge portion 41*c* is formed with a height which allows the cover edge portion 41*c* to come into contact with the specific peripheral edge of the support body 21*c* when the peripheral edges of the protection cover 40C are brought into contact with the edge portion 25*c*. Incidentally, the protection cover 40C is set on the support body 21*c* with joining means such as an adhesive.

The lighting device 1C having the above-described construction outputs light from the light emitters 10 in directions perpendicular to the curving attachment faces 22*c*. The light from the lighting device 1C is set such that the optical axes of the light-emitting elements 12 are directed in their respective directions to the places of the light-emitting elements 12 on the attachment faces 22*c*. Furthermore, although the shapes of the attachment faces 22*c* are curved, the light emitters 10 are easy to set since the flexible boards 11 are attached to the attachment faces 22*c* according to the shapes of the attachment faces 22*c* in the longitudinal directions of the attachment faces 22*c*. Since the light emitters 10 need not be bent at extreme angles or slit, the circuit patterns of the light emitters 10 are less likely to deteriorate.

Figure 9:
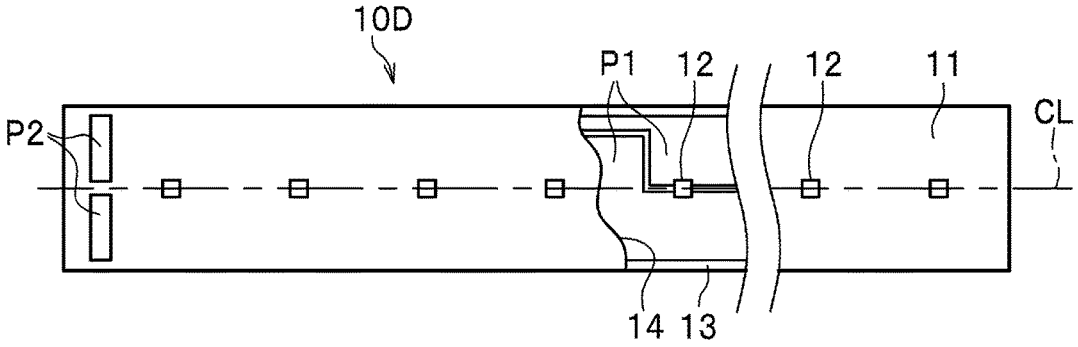
FIG. 9 is a plan view schematically illustrating an application example of a light emitter used in the lighting devices of the respective embodiments with part of the application example omitted from the plan view.
Figure 10:
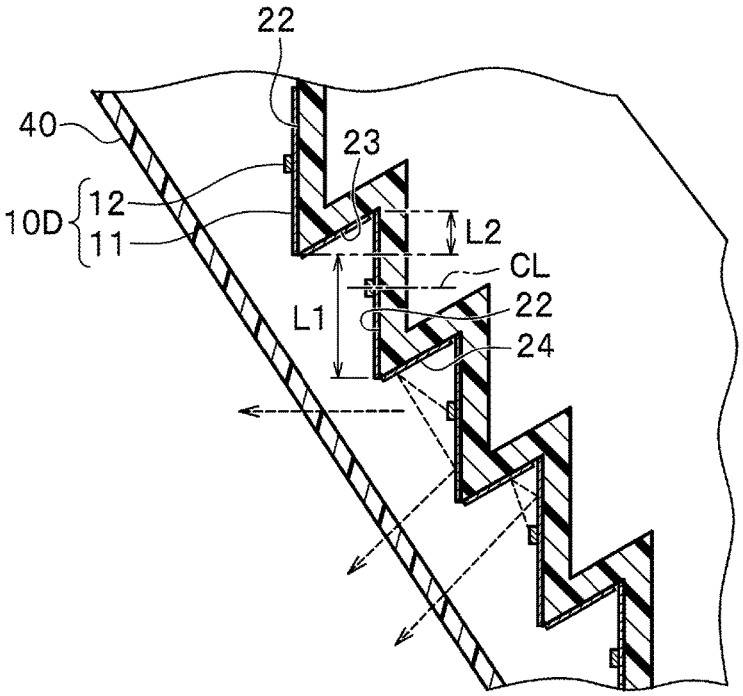
FIG. 10 is a cross-sectional view schematically illustrating a positional relationship between the flexible board and the light emitting elements in the light emitter illustrated in FIG. 9 with part of the light emitter omitted from the cross-sectional view.

It should be noted that the foregoing descriptions have been provided for the first to third embodiments each having the construction in which the light-emitting elements 12 are arranged on each flexible board 11 while offset from the center line CL to the one side end of the flexible board 11. Nevertheless, as in the case of light emitters 10D illustrated in FIGS. 9 and 10, the light-emitting elements 12 may be set along the center of each flexible board 11 in the width direction. It should be noted that in the front view, when each light emitter 10D is attached to the attachment face 22 (22*c*), the upper area L2 of the flexible board 11 covered by the above-placed attachment face 22 (22*c*) may be above the center line CL of the flexible board 11. The lighting devices 1, 1B, 1C using the light emitters 10D like this output light emitted from the light-emitting elements 12 such that the emitted light travels toward the connecting faces 23 (23*c*), is subsequently reflected by the light-reflecting members 24 (24*c*), thus travels toward the flexible boards 11, is thereafter reflected by the flexible boards 11, and eventually passes through the protection cover 40 (40*c*). The light emitters 10D and the light emitters 10 are different in orientation characteristic from each other when used for the same base member 20, for example. For this reason, the light emitters 10D and the light emitters 10 are selectively used depending on use purposes.

In addition, although the foregoing descriptions have been provided for the first to third embodiments in which the base member 20 is an integrated unit including the support body 21 and the heat radiation mechanism 30, the support body 21 and the heat radiation mechanism 30 may be formed as separate bodies.

Moreover, although the foregoing descriptions have been provided for the attachment faces 22 which are the flat faces, the attachment faces 22 may be formed to have a slope on which gentle unevenness continues in order to direct the optical axes of the light-emitting elements 12 on the flexible boards 11 in two, three or four directions. The gentle slope formed on the attachment faces 22 may incline in the up-down direction, the left-right direction, or the like.

Furthermore, although the foregoing descriptions have been provided for the support body 21 including the edge portion 25 or the edge portion 25*c*, the edge portion 25 and the edge portion 25*c* may be each formed as separate bodies. Otherwise, the whole edge portion 25 and the whole edge portion 25*c* may be provided to the protection cover 40 and the protection cover 40C, respectively.

Besides, although the foregoing descriptions have been provided for the protection covers 40, 40C which are attached to the support bodies 21, 21*c* using an adhesive or the like, the protection covers 40, 40C may be detachably attached to the support bodies 21, 21*c* by providing engagement mechanisms to the protection covers 40, 40C and the support bodies 21, 21*c*.

In addition, in the lighting device 1C, the heat radiation mechanism 30 (not illustrated) suited to the shape of the base member 20C may be set on the back surface of the base member 20C by being integrated together, or by being connected together as separate bodies.

Furthermore, no restriction is imposed on the shape of the base member, and the base member may be shaped like a ring or the like, as long as the flexible boards 11 of the light emitters 10 can be attached to the attachment faces without being folded at angles.

Figure 11:
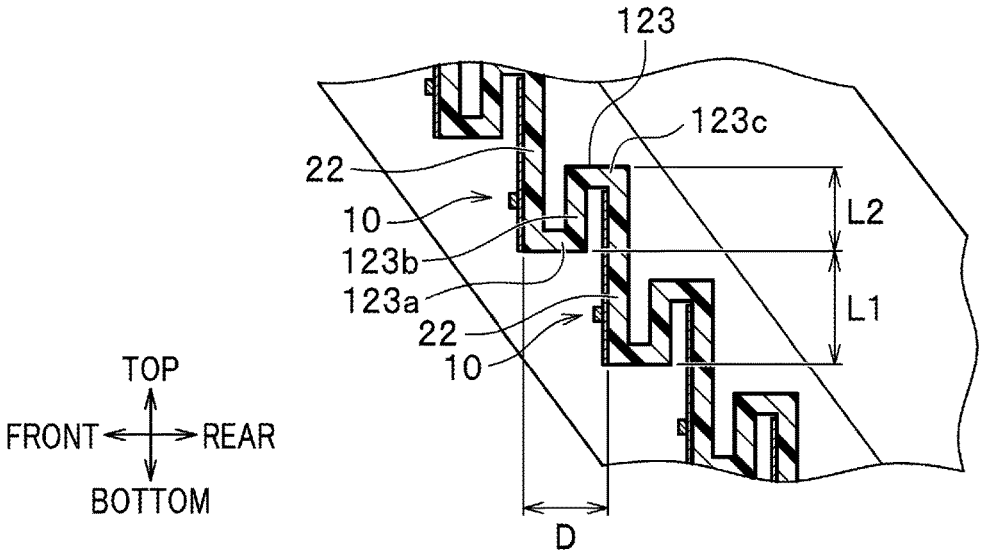
FIG. 11 is an enlarged cross-sectional view schematically illustrating a construction of an application example of the base members in the respective embodiments with part of the application example omitted from the enlarged cross-sectional view.
Figure 12:
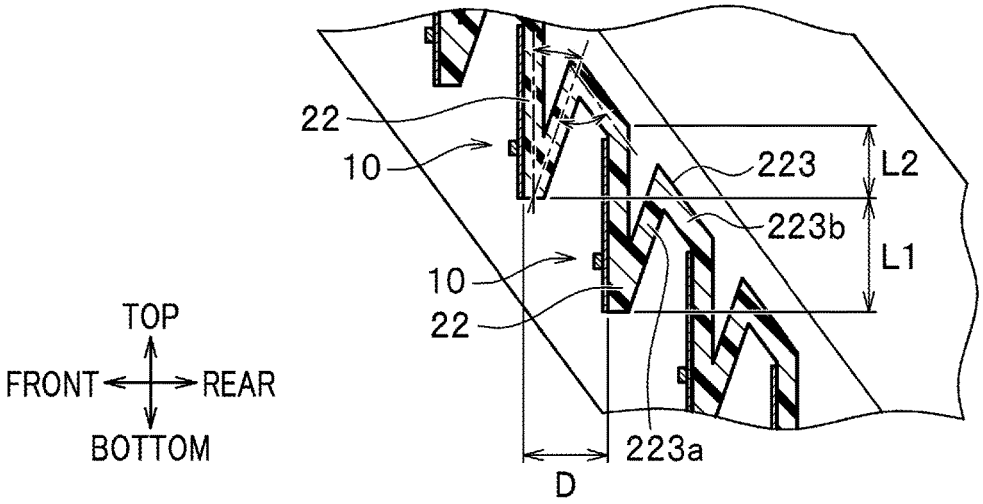
FIG. 12 is an enlarged cross-sectional view schematically illustrating another construction of the application example of the base members in the respective embodiments with part of the application example omitted from the enlarged cross-sectional view.

The first to third embodiments may be such that the connecting faces have a construction illustrated in FIGS. 11 and 12 instead of the constructions illustrated in FIGS. 1 to 10.

To put it specifically, as illustrated in FIG. 11, a connecting face 123 may be provided by connecting one end of the connecting face 123 to one end of one (an upper) attachment face 22; and connecting the other end of the connecting face 123 to an upper end of another (a lower) attachment face 22, with two bent portions of the connecting face 123 interposed in between the attachment faces 22. The connecting face 123 includes: a first horizontal portion 123*a* connected to one end of an attachment face 22; a vertical portion 123*b* continuing from the first horizontal portion 123*a* via one bent portion; and a second horizontal portion 123*c* continuing from the vertical portion 123*b* via the other bent portion. The construction of the connecting face 123 causes one attachment face 22 connected to one end of the connecting face 123 to exist above and away from one end of another attachment face 22 connected to the other end of the connecting face 123. Because of the construction of the connecting face 123 including the bent portions, a ratio of the area L2 of the portion overlapping the above-placed attachment face 22 to the area L1 of the remaining portion not overlapping the above-placed attachment face 22 may be independently controlled by adjusting the length of the vertical portion 123*b*, without involving a depth-direction adjustment. Furthermore, the depth D can be independently controlled by adjusting the lengths of the first and second horizontal portions 123*a*, 123*b*, without involving the adjustment of the areas L2, L1.

As illustrated in FIG. 12, a connecting face 223 may be provided by connecting one end of the connecting face 223 to one end of one (an upper) attachment face 22; and connecting the other end of the connecting face 223 to an upper end of another (a lower) attachment face 22, with one bent portion of the connecting face 223 interposed in between the attachment faces 22. The connecting face 223 includes: a first slope 223*a* connected to one end of an attachment face 22; and a second slope 223*b* continuing from the first slope 223*a* via the bent portion. The construction of the connecting face 223 causes one attachment face 22 connected to one end of the connecting face 223 to exist above and away from one end of another attachment face 22 connected to the other end of the connecting face 223. Because of the construction of the connecting face 123 including the bent portion, a ratio of the area L2 of the portion overlapping the above-placed attachment face 22 to the area L1 of the remaining portion not overlapping the above-placed attachment face 22 may be independently controlled by adjusting the length or angle of either the first slope 223*a* or the second slope 223*b*, without involving a depth-direction adjustment. In addition, the depth D can be independently controlled by adjusting the length or angle of either the first slope 223*a* or the second slope 223*b*, without involving the adjustment of the areas L2, L1. Incidentally, in this case, the inclination angles of all the second slopes 223*b* are set such that the second slopes 223*b* are arrayed in a line. Since the second slopes 223*b* are aligned in a line, the base member can be easily produced by being molded using a die or the like. Incidentally, the first slope 223*a* and the second slope 223*b* may be set to have predetermined angles.

It should be noted that the attachment faces 22 and the connecting faces 23 (23*c*, 123, 223) may be integrally formed of resin, or may be formed in a continuous stair shape by bonding units each including one attachment face 22 and one connecting face 23 (23*c*, 123, 223) with an adhesive. Furthermore, the attachment faces 22 illustrated in FIGS. 11 and 12 may employ a construction, like in the light emitters 10D illustrated in FIGS. 9 and 10, in which the light-emitting elements 12 are provided along the width-direction center of the flexible board 11.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A lighting device comprising:

a base member including a first attachment face and a second attachment face with a step therebetween, and a connecting face extending between the first attachment face and the second attachment face;

a first board fixed on the first attachment face;

a second board fixed on the second attachment face;

a first light-emitting element mounted on the first board; and a second light-emitting element mounted on the second board, wherein the first attachment face is disposed in front of the second attachment face, wherein the first attachment face and the second attachment face overlap each other with an overlap area therebetween, wherein the second light-emitting element is disposed in an area of the second attachment face other than the overlap area, wherein the base member includes a reflector fixed on the connecting face, and wherein the reflector is disposed in the overlap area and inclines toward the second light-emitting element relative to the second attachment face.

2. The lighting device according to claim 1, wherein the connecting face inclines relative to the first attachment face at an acute angle.

3. The lighting device according to claim 1, wherein the second light-emitting element is mounted offset from a center of the second board to a one-end side of the second board in a width direction of the second board orthogonal to a longitudinal direction of the second board.

4. The lighting device according to claim 1, wherein the first board and second board are flexible.

5. The lighting device according to claim 4, wherein the first attachment face is curved in a longitudinal direction of the first board, wherein the second attachment face is curved in a longitudinal direction of the second board, wherein the first board is curvedly disposed along the first attachment face, and wherein the second board is curvedly disposed along the second attachment face.

6. The lighting device according to claim 1, further comprising:

a first lens facing the first light-emitting element, and a second lens facing the second light-emitting element.

7. The lighting device according to claim 1, wherein the connecting face is disposed in the overlap area and inclines relative to the second attachment face at an acute angle.

8. The lighting device according to claim 1, wherein the first attachment face includes an end in the overlap area, wherein the second attachment face includes an end in the overlap area, and wherein the connecting face extends from the end of the first attachment face to the end of the second attachment face.

9. The lighting device according to claim 1, wherein the first board and the second board are reflective.

10. The lighting device according to claim 1, wherein the second light-emitting element emits light, which travels toward the connecting face to be reflected by the reflector, and travels to the second attachment face to be reflected by the second board, thus being outputted from the lighting device.

* * * * *